US005906878A

United States Patent [19]

Horning et al.

[11] Patent Number: 5,906,878

[45] Date of Patent: May 25, 1999

[54] APPARATUS AND METHOD FOR DETERRING SLIPPAGE OF A SLIP COVER OR CUSHION PLACED ON FURNITURE

[76] Inventors: Deborah K. Horning, 1317 W. 15th St. Pl. S; Diana W. May, 1414 W. 3rd St. Pl. N, both of Newton, Iowa 50208

[21] Appl. No.: 08/855,604

[22] Filed: May 13, 1997

Related U.S. Application Data

[63] Continuation of application No. 08/537,006, Oct. 2, 1995, abandoned.

[51] Int. Cl.[6] ..... B32B 3/24; A47C 31/11

[52] U.S. Cl. ..... 428/131; 428/138; 297/219.1; 297/218.1; 297/218.2

[58] Field of Search ..... 428/131, 138; 297/219.1, 218.1, 218.2

[56] References Cited

U.S. PATENT DOCUMENTS

| | | | |
|---|---|---|---|
| 1,914,402 | 7/1933 | Charbonneau | 442/0 |
| 1,985,203 | 12/1934 | Charbonneau | 428/496 |
| 2,298,664 | 10/1942 | Van Patter | 117/27 |
| 2,502,353 | 3/1950 | Sullivan | 117/76 |
| 2,791,268 | 5/1957 | Mendelsohn | 297/452 |
| 3,028,280 | 4/1962 | Hoffman | 154/53.5 |
| 3,220,767 | 11/1965 | Hendrickson | 297/228.12 |
| 3,514,365 | 5/1970 | Burnett et al. | 161/39 |
| 3,804,699 | 4/1974 | Johnson | 161/39 |
| 3,930,090 | 12/1975 | Campbell, Sr. et al. | 428/196 |
| 4,286,003 | 8/1981 | Higgins et al. | 428/95 |
| 4,457,032 | 7/1984 | Clarke | 297/481 |
| 4,515,852 | 5/1985 | Katabe et al. | 428/246 |
| 4,613,537 | 9/1986 | Krupper | 428/192 |
| 4,721,641 | 1/1988 | Bailey | 428/88 |
| 4,723,814 | 2/1988 | Hunt | 297/219 |
| 4,772,070 | 9/1988 | Leto, Jr. et al. | 297/219 |
| 4,828,898 | 5/1989 | Bailey | 428/88 |
| 5,015,037 | 5/1991 | Giblin et al. | 297/452 |
| 5,171,619 | 12/1992 | Reuben | 428/95 |
| 5,322,729 | 6/1994 | Heeter et al. | 428/306 |
| 5,346,278 | 9/1994 | Dehondt | 297/219 |
| 5,429,852 | 7/1995 | Quinn | 428/71 |

*Primary Examiner*—William P. Watkins, III
*Attorney, Agent, or Firm*—Zarley, McKee, Thomte, Voorhees & Sease

[57] ABSTRACT

An apparatus and method for deterring slippage of a seat cushion, arm chair slip cover, or head slip cover relative to a chair seat, furniture arm, or seat back includes a relatively thin layer of material having characteristics which resists slippage of the cushion or slip cover relative to the furniture. The layer is formed to conform with the perimeter outline of the cushion or slip cover. The layer holds the cushion or slip cover in place preventing premature costly replacement of chair cushions or slip covers.

8 Claims, 4 Drawing Sheets

APPARATUS AND METHOD FOR DETERRING SLIPPAGE OF A SLIP COVER OR CUSHION PLACED ON FURNITURE

This application is a continuation of application Ser. No. 08/537,006 filed on Oct. 2, 1995 abandoned.

BACKGROUND OF THE INVENTION

A. Field of the Invention

This invention relates to slip covers and cushions such as are used on seats, chairs, furniture arms and seat backs, and wheelchairs, and in particular, an apparatus and method to prevent slippage of the slip cover or cushion relative to the furniture.

B. Problems in the Art

Seat cushions for wood, rattan, wicker, vinyl, or metal chair seats, and arm or head slip covers for chair and couch arms and seat backs have long been used with respect to furniture for purposes of comfort and to prolong the life of fabric. In both cases, slippage of the cushion or slip cover relative to the furniture has been a problem. Generally the fabric or other covering for seat cushions rather easily slips or slides on a smooth wood, metal, or other relatively smooth seat. Fabric-on-fabric armchair or seat back slip covers also tend to slide or slip relative to one another. This is true even if the fabrics are identical. Other methods have been used.

Various attempts to secure the cushions or slip covers to the furniture have been attempted. Strings or ties have been sewn or secured to cushions to tie the cushions to chairs. Pins or similar devices which stick through fabric of both the slip cover and furniture or fabric have been used to secure slip covers.

Seat slip covers tied to chairs still slide even on smooth chair surface. Breakage of the ties is not uncommon. The sliding and movement of a seat cushion, even when tied, causes accelerated wear on the seat cushion. The use of pins to secure slip covers to fabric furniture arms and backs anchors only certain points of the slip cover and does not anchor the entire surface of the slip cover. Pins can poke and even injure users of the furniture, can fall out, and can damage or even rip fabric.

In either the case of the ties or the pins, removal or mounting of the cushion or slip cover takes some time. It also is not very convenient when removing the cushion or slip cover for cleaning. Permanent securement of the cushion or slip cover has obvious disadvantages.

There have been attempts to provide non-slip cushions or materials. Examples are as follows.

Dehondt U.S. Pat. No. 5,346,278, is entitled "Non-slip Cushion" and provides a cushion tied to a highchair. A rubbery polymeric material is deposited on a scrim fabric to attempt to prevent an infant sitting on the cushion in the highchair from sliding forward.

Gilbin U.S. Pat. No. 5,015,037 discloses a high chair with a non-slip seat made of a solid, rubbery material.

Quinn U.S. Pat. No. 5,429,852, is entitled "Transportable Chair Pad" and has a bottom, non-clickable ester urethane foam layer that has a high coefficient of friction to keep the pad from slipping on the chair seat.

Katabe, et al. U.S. Pat. No. 4,515,852 describes a leather-like sheet material having low-slip characteristics and gives as examples use for balls, baseball gloves, bags, cases, and the like which are required to prevent slipperiness.

Clarke U.S. Pat. No. 4,457,032 discloses a seat cushion having a flexible resilience synthetic plastic foam having a high coefficient of friction to attempt to keep it in place on the car seat.

Van Patter U.S. Pat. No. 2,298,664 describes a non-slip grit material.

Charbonneau U.S. Pat. Nos. 1,914,402 and 1,985,203 describe an anti-slip product and method of making the same for such things as preventing slippage of a rug on the floor or supporting a rug, mat, desk pad, telephone or the like.

The foregoing patents either utilize some sort of rubberized coating on an underlying fabric base or some sort of coating secured directly to the slip cover or cushion to attempt to deter slippage of an item relative to another item. None of these patents, or any other prior art known to the applicants, specifically addresses the problem of deterring slippage of a fabric, seat cushion or furniture chair or seat back slip cover relative to the chair or furniture which does not require manual securement, assists in non-slippage across the whole interface of cushion or slip cover to furniture, is thin, non-complex in structure, and provides a good seat surface to fabric or fabric-to-fabric non-slip relationship.

It is therefore a principle object of the present invention to provide an apparatus and method which solves the problems in the art or improves upon the problems in the art.

Another object of the present invention is to provide an apparatus and method which is completely independent of the furniture or the cushion or slip cover and does not require adhesives, ties or any other securement devices to keep it in place in normal circumstances.

Another object of the present invention is to provide an apparatus and method which is economical and durable, can be used inside or outside, and can be adopted to a variety of different sizes and shapes.

Another object of the present invention is to provide an apparatus and method which prolong the life of seat cushions and arm or head slip covers for furniture.

Another object of the present invention is to provide an apparatus and method which prevents moisture or humidity build-up and allows passage of air to deter permanent marks or other deposits or buildup on the furniture.

A still further object of the present invention is to provide an apparatus and method which is relatively thin so that there is no significant increase in height in the cushion or slip cover.

Another object of the present invention is to provide an apparatus and method which prevents slippage between a cloth or fabric cushion or slip cover and a chair seat or a cloth or fabric furniture arm or seat back.

Another object of the present invention is to provide an apparatus and method which is easily and quickly removeable and insertable, and easily cleanable.

These and other objects, features, and advantages of the present invention will become apparent with reference to the accompanying specification and claims.

SUMMARY OF THE INVENTION

An apparatus and method for deterring slippage between a chair cushion, arm slip cover, or head slip cover and a chair seat or furniture arm or seat back. The method includes placing a relatively thin layer of material between the cushion or slip cover and a portion of the furniture on which the cushion or slip cover sits. The material is cut to conform with the shape of the cushion or slip cover. The material has properties to deter slippage between the fabric type cushion or slip cover and either a seat surface or a fabric arm chair or seat back.

The apparatus includes an independent relatively thin sheet of material or pad which is flexible and has the slip resistant characteristics for fabric or seat surfaces.

DETAILED DESCRIPTION OF THE PREFERRED EMBODIMENT

Figure 1:
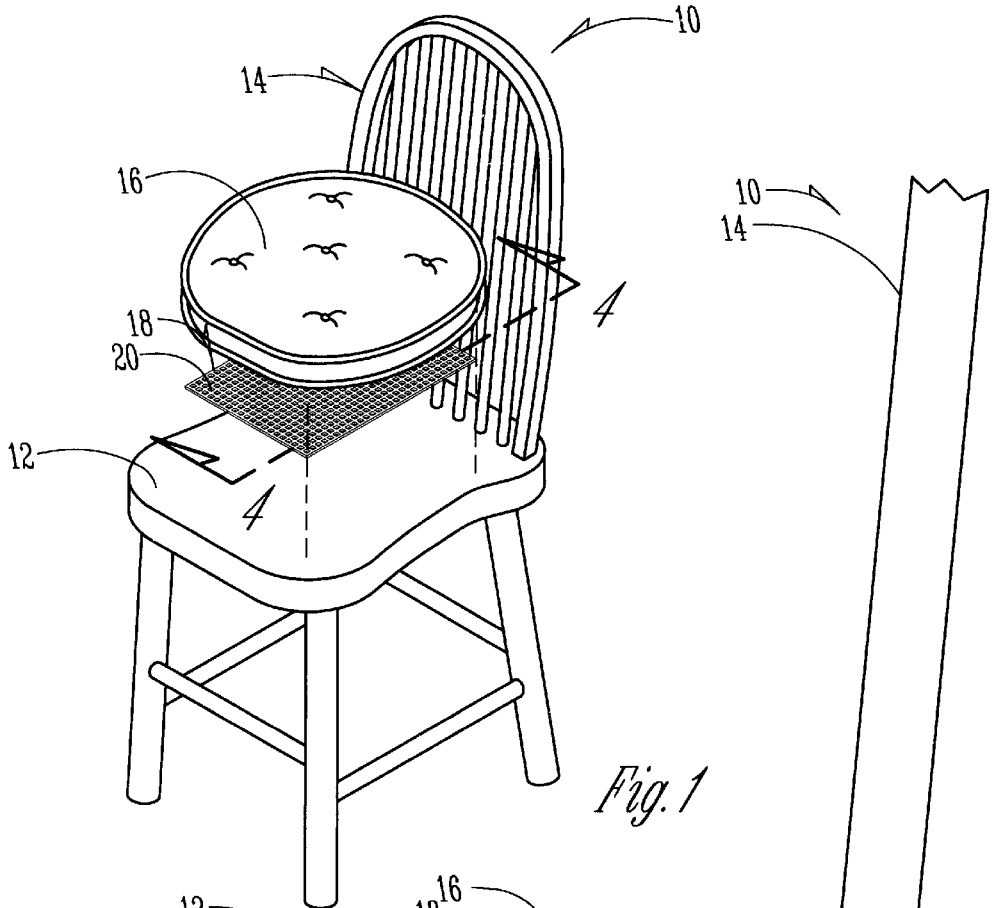
FIG. 1 is a perspective view in exploited form, of an embodiment of the invention utilized between a seat cushion and a chair seat.

To better understand the invention, a detailed description of one embodiment of the invention will now be set forth. It is to be understood that this detailed description is of one embodiment only of the invention and does not and is not intended to limit the scope of the invention or the different embodiments it can take.

Reference will be frequently taken to the drawings. Reference numbers will be utilized to indicate certain parts and locations in the drawings. The same reference numbers will be used to indicate the same parts and locations throughout all of the drawings unless otherwise indicated.

FIG. 1 illustrates a wood chair 10 having a relatively smooth seat 12 and chair back 14. A seat cushion 16 is placeable on chair seat 12. Cushion 16 can be any type of seat cushion but in this embodiment consists of a cushioning material such as foam, rubber, nylon, or cotton wading contained within a fabric exterior cover. A layer 18 made according to the present invention, fits between cushion 16 and seat 12 to deter slippage between cushion 16 and seat 12. Layer 18 is cut or formed to generally correspond with the shape of seat 12 and cushion 16. It is an independent member relative to cushion 16 and chair 10 and can be lifted off of seat 12 and separated from cushion 16 quickly and easily to clean seat 12 or for other reasons.

Figure 2:
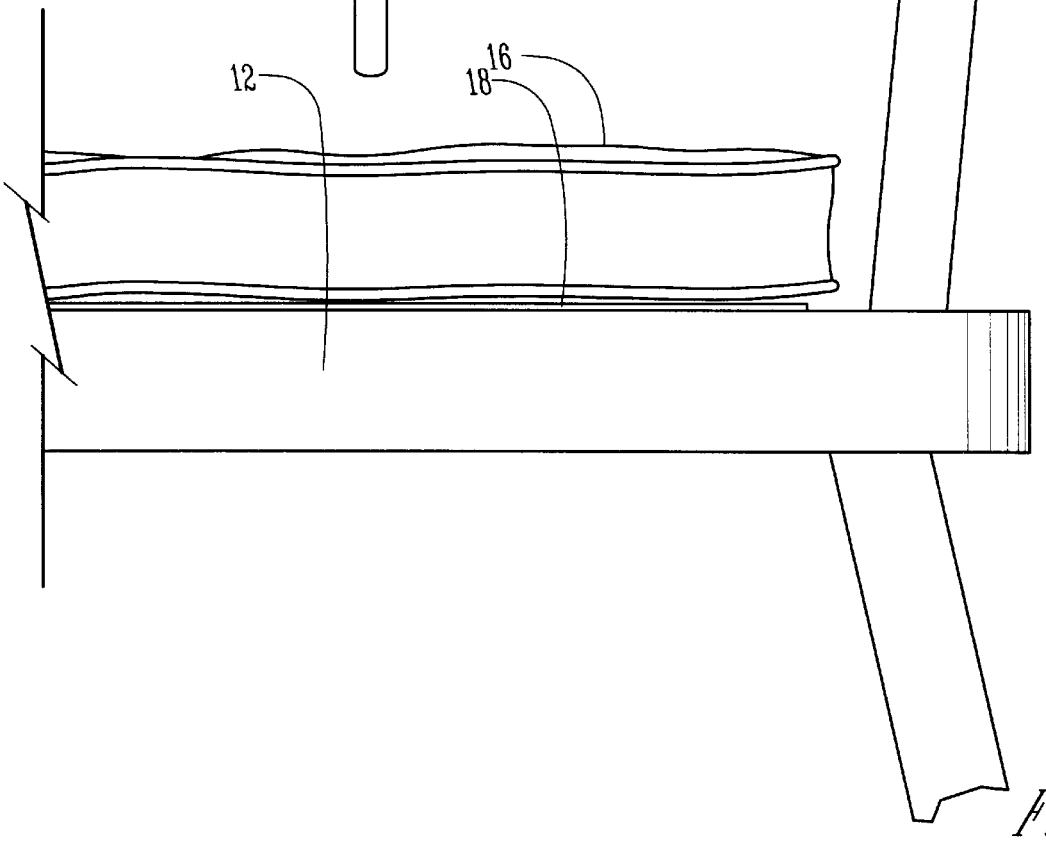
FIG. 2 is a side view of the seat cushion, embodiment of the invention, and chair seat of FIG. 1 in abutment with one another.

FIG. 2 illustrates by side view cushion 16 and layer 18 placed on seat 12. Regardless of whether anyone is sitting on chair 10, cushion 16 does not easily move relative to seat 12 because of the existence of layer 18 which extends across the whole interface between cushion 16 and seat 12.

As can be seen in FIG. 2, layer 18 is relatively thin as compared to cushion 16 and seat 12. In the preferred embodiment layer 18 is approximately ⅛" thick. It therefore does not materially increase the height of cushion 16 when placed on seat 12.

Figure 3:
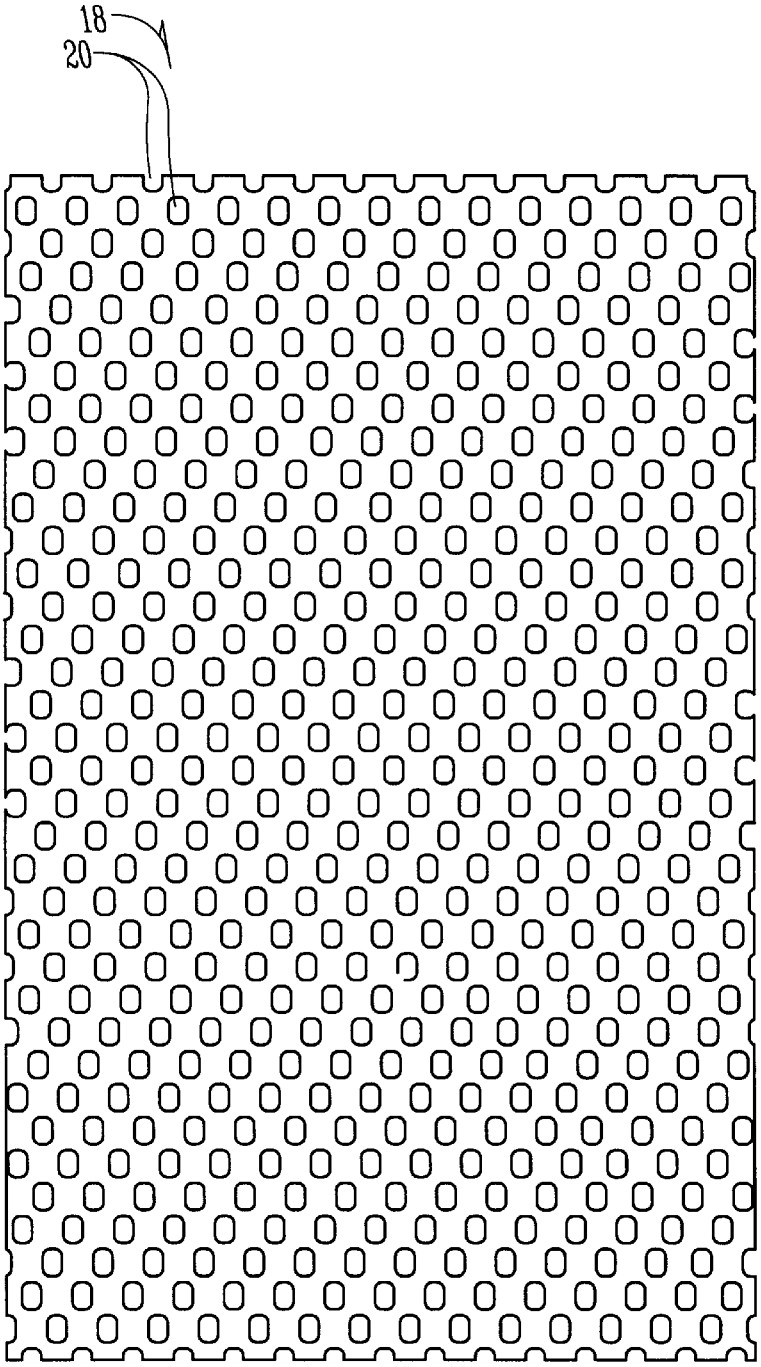
FIG. 3 is an isolated plan view of the embodiment of the invention of FIG. 1.

FIG. 3 illustrates layer 18 in plan view. In this embodiment, layer 18 is formed so that there are openings 20 equally spaced throughout layer 18. In this embodiment openings 20 are basically rectangular or square in shape (approximately 2 mm by 4 mm). Layer 18 has an outer perimeter of approximately 11½" by 11½" dimensions. Also, openings 20 are spaced approximately ⅛" apart.

Figure 4:
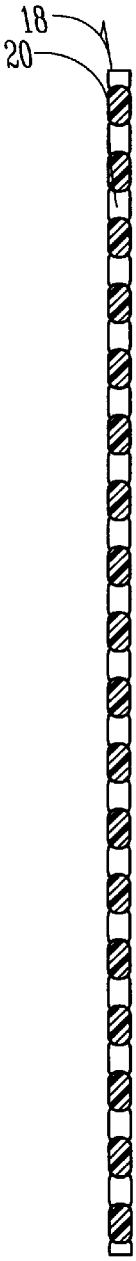
FIG. 4 is an edge view of the embodiment of FIG. 3.
Figure 6:
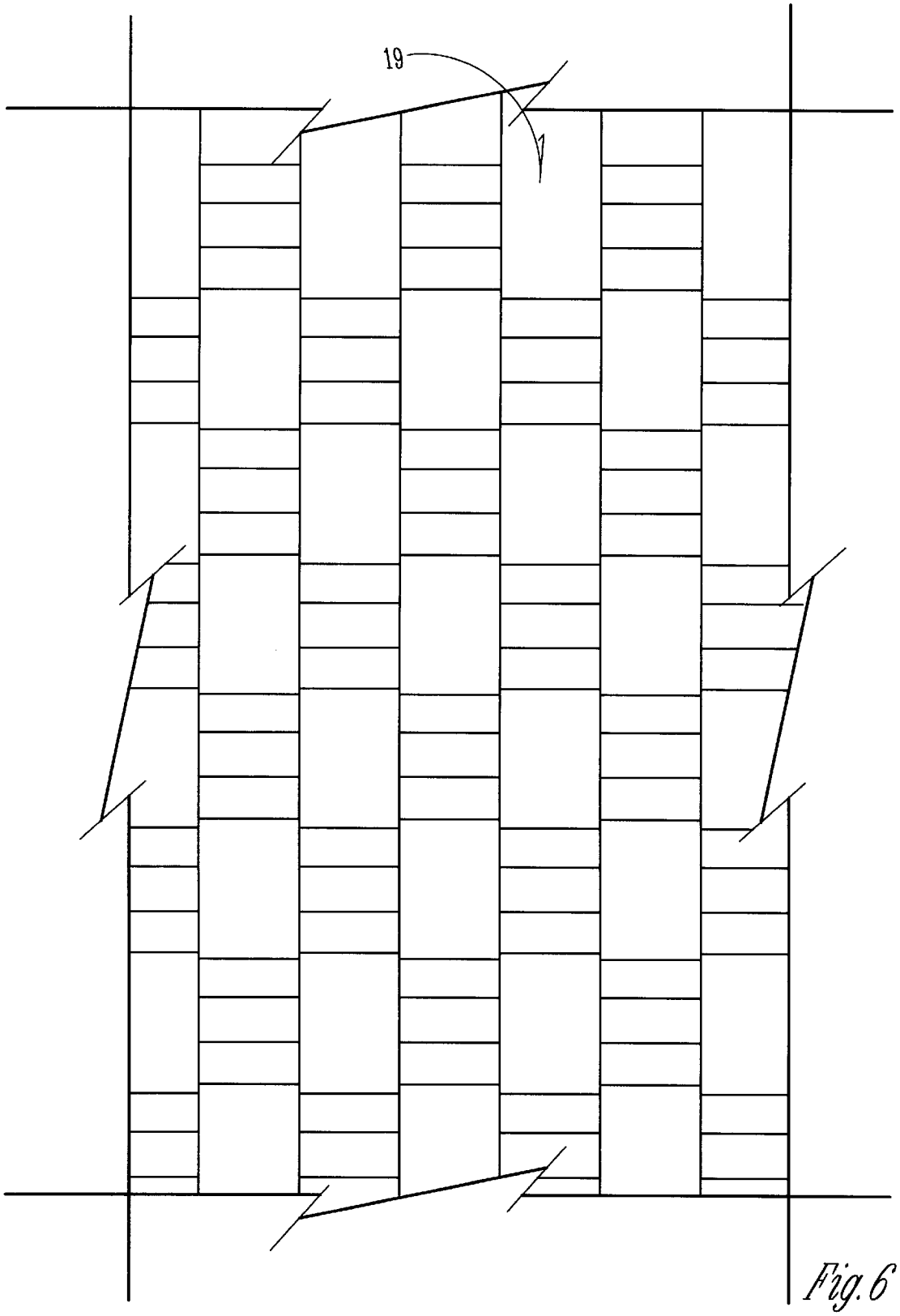
FIG. 6 is a diagrammatic depiction of the underlying knit or scrim of the embodiment of FIG. 3.

FIG. 4 illustrates a cross-sectional view of layer 18. It can be seen that openings 20 extend all the way through layer 18. In the preferred embodiment layer 18 is made of a material having flexibility and resiliency to stretching. The material for layer 18 can be purchased from American Non-Slip Products, Inc. of 2924-A Anwiler, Doraville, Ga. 30360 under the name PREMIERE, which is a trademark of American Non-Slip Products, Inc. The material is described by American Non-Slip Products, Inc. as PREMIERE pattern polyester scrim coated with poly vinyl chloride (PVC)—fiber reinforced. In the preferred embodiment, the material is treated with small amounts of fire retardent (for example, antimony oxide) that meets U.S. Department of Commerce FF 1 70 flame retardent standards and has been treated with AMERFRESH, a trademark treatment of American Non-Slip Products, Inc., containing a small amount of fungicide for mold and mildew resistance and moth proofing. The PREMIERE pattern is a polyester knit or mesh pattern with polymers of PVC in primary form plasticized. The underlying scrim mesh 19 (see FIG. 6) is basically coated with liquid PVC which includes the flame retardent, mold and mildew resistance and moth proofing treatment. It is baked and the PVC forms a plastisol foam around the knit (FIG. 6) but leaves openings where there is no knit or reinforcing fibers. Its characteristics are such that it is flexible so that it can be conformed to a variety of shapes and contours, is resilient to survive compression and stretching, and also has a tackiness or coefficient of friction that deters slippage of fabric and surfaces such as chair seats or fabric on one side and fabric on the other. The material is not adhesive in the sense that it leaves some sort of residue on a seat or furniture arm or seat back but rather the stickiness of the material is such that it deters slippage of such materials. Also, the material is very durable and resists degradation over time or over the application of compression by people sitting on the seat and the like. The material does not harm or cause deterioration of any type of furniture.

It is to be understood that the material of layer 18 can vary somewhat in thickness as well as its makeup. For example, openings 20 can be of different shapes and sizes, as can the configuration of the underlying knit mesh. Similar materials with similar characteristics could also be utilized.

Figure 5:
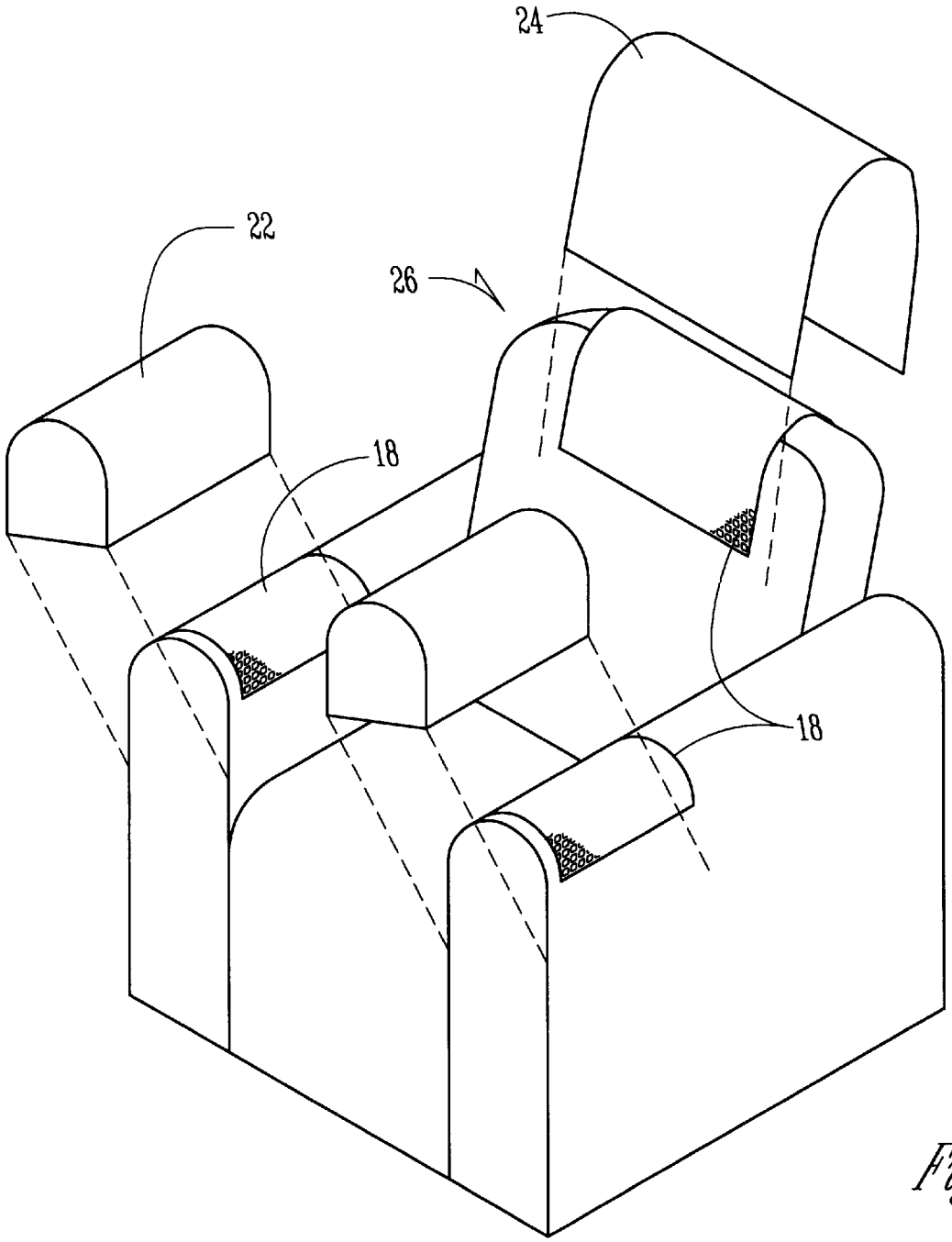
FIG. 5 is a perspective view sharing an embodiment of the invention with respect to a fabric arm chair slip cover on a fabric arm chair and a fabric head slip cover on a fabric seat back.

FIG. 5 illustrates in perspective the use of layer 18 to deter slippage of a fabric arm chair slip cover 22 or a fabric head slip cover 24. As with cushion 16 of FIG. 1, layer 18 and its properties are such that it can be conformed to the furniture arm or seat back and a fabric slip cover can be placed on top of it and be held in place.

It will be appreciated that the present invention can take many forms and embodiments. The true essence and spirit of this invention are defined in the appended claims, and it is not intended that the embodiment of the invention presented herein should limit the scope thereof.

For example, layer 18 could be used on conventional furniture such as dining or living room chairs or couches. It could also be used on wheel chairs to hold an additional separate seat cushion over the original seat cushion or a seat back cover to the seat back. Other uses are possible such as holding all or part of covers that cover an entire couch or chair in place.

We claim:

1. A method of preventing or deterring slippage of a fabric covered chair cushion on a smooth and relatively hard-surfaced chair seat comprising:

creating a separate, independent, and separable layer of material having a characteristic that deters slippage relative to fabric or a smooth surface, the layer approximately one-eighth inch thick, having a perimeter, and made of a mesh coated with foamed polymeric material, the mesh and polymeric material defining pillow shaped portions having somewhat rounded surfaces separated by openings, the layer being flexible and resilient to bending and stretching and having a tackiness relative to fabric and relatively smooth and hard surfaces without adhesion or residue to or on the fabric or relatively smooth and hard surface, the perimeter being free of any border, binding, or attaching straps or ties, the layer being made of a knit polyester scrim coated with PVC which is fiber reinforced, the knit defining openings generally uniformly spaced apart in a pattern, the openings being generally rectangular in shape on the order of 2 to 4 mm per side and spaced about ⅛ inch apart;

making the perimeter of the layer similar in size to the chair cushion;

placing the layer between said chair cushion and said chair seat.

2. The method of deterring movement of a separate chair cushion having a cloth or fabric surface relative to a separate underlying smooth and relatively hard chair seat comprising:

creating a separate, independent, and separable thin approximately one-eighth inch thick layer of material that deters movement of the chair cushion relative to the layer and the layer relative to the chair seat, the layer approximately one-eighth inch thick, having a perimeter, and made of a mesh coated with foamed polymeric material, the mesh and polymeric material defining pillow shaped portions having somewhat rounded surfaces separated by openings, the layer being flexible and resilient to bending and stretching and having a tackiness relative to fabric and relatively smooth and hard surfaces without adhesion or residue to or on the fabric or relatively smooth and hard chair seat, the perimeter being free of any border, binding, or attaching straps or ties, the layer being made of a knit polyester scrim coated with PVC which is fiber reinforced, the knit defining openings generally uniformly spaced apart in a pattern, the openings being generally rectangular in shape on the order of 2 to 4 mm per side and spaced about ⅛ inch apart;

cutting a shape out of the layer that generally conforms to the shape of the cloth or fabric surface of the chair cushion;

placing a layer between the chair cushion and the chair seat.

3. The method of claim 2 wherein the chair seat is made of wood.

4. The method of claim 2 wherein the chair seat is made of at least one of wood, rattan, wicker, vinyl, leather, fabric, or metal.

5. The method of claim 2 wherein the material is treated with one or more of a fire retardent, mold and mildew resistance, and moth proofing.

6. A device for deterring movement of a chair cushion relative to a chair cushion, said chair cushion being without structural connection to the chair comprising:

a separate chair cushion having a cloth or fabric surface;

a separate chair having a relatively smooth and hard chair seat surface;

a relatively thin layer of flexible material placed between the chair cushion and the chair seat that deters movement of the chair cushion relative to the layer and the layer relative to the chair seat, the layer made of a mesh coated with a foamed polymeric material, the layer approximately one-eighth inch thick, having a perimeter, and made of a mesh coated with foamed polymeric material, the mesh and polymeric material defining pillow shaped portions having somewhat rounded surfaces separated by openings, the layer being flexible and resilient to bending and stretching and having a tackiness relative to fabric and relatively smooth and hard surfaces without adhesion or residue to or on the fabric or relatively smooth and hard surface, the perimeter being free of any border, binding, or attaching straps or ties, the layer being made of a knit polyester scrim coated with PVC which is fiber reinforced, the knit defining openings generally uniformly spaced apart in a pattern, the openings being generally rectangular in shape on the order of 2 to 4 mm per side and spaced about ⅛ inch apart; and perimeter edges of the layer generally conforming to perimeter edges of the chair cushion and the chair seat.

7. The device of claim 6 wherein the layer is treated with one or more of a fire retardent, mold and mildew resistance, and moth proofing.

8. A method of use of a relatively thin layer of PVC coated scrim mesh for deterring slippage of a seat cushion comprising:

creating the layer out of mesh coated with polymeric material, the layer approximately one-eighth inch thick, having a perimeter, and made of a mesh coated with foamed polymeric material, the mesh and polymeric material defining pillow shaped portions having somewhat rounded surfaces separated by openings, the layer being flexible and resilient to bending and stretching and having a tackiness relative to fabric and relatively smooth and hard surfaces without adhesion or residue to or on the fabric or relatively smooth and hard surface, the perimeter being free of any border, binding, or attaching straps or ties, the layer being made of a knit polyester scrim coated with PVC which is fiber reinforced, the knit defining openings generally uniformly spaced apart in a pattern, the openings being generally rectangular in shape on the order of 2 to 4 mm per side and spaced about ⅛ inch apart;

cutting the layer of mesh to generally coincide with perimeter edges of the seat cushion;

placing the mesh, after cutting it to the conforming shape, over the seat; and placing the seat cushion over the layer.

* * * * *